US010001344B1

(12) United States Patent
ALford et al.

(10) Patent No.: US 10,001,344 B1
(45) Date of Patent: Jun. 19, 2018

(54) RISER FOR FIREARMS ACCESSORY RAILS

(71) Applicants: Michael B ALford, Weatherford, TX (US); Ashley C Emerson, Weatherford, TX (US)

(72) Inventors: Michael B ALford, Weatherford, TX (US); Ashley C Emerson, Weatherford, TX (US)

( * ) Notice: Subject to any disclaimer, the term of this patent is extended or adjusted under 35 U.S.C. 154(b) by 104 days.

(21) Appl. No.: 15/000,046

(22) Filed: Jan. 19, 2016

Related U.S. Application Data

(60) Provisional application No. 62/105,203, filed on Jan. 19, 2015.

(51) Int. Cl.
*F41A 27/00* (2006.01)
*F41G 11/00* (2006.01)

(52) U.S. Cl.
CPC ..... *F41G 11/003* (2013.01)

(58) Field of Classification Search
CPC ..... F41G 11/001; F41G 11/002; F41G 11/003
See application file for complete search history.

(56) References Cited

U.S. PATENT DOCUMENTS 5,606,818 A * 3/1997 Hardee ..... F41G 11/003 42/124
5,694,712 A * 12/1997 Plonka ..... F41G 11/003 42/124
8,752,325 B2 * 6/2014 Ding ..... F41G 11/003 42/124
9,677,854 B1 * 6/2017 Tran ..... F41G 11/003
2003/0230022 A1 * 12/2003 Battaglia ..... F41G 11/003 42/111
2004/0000083 A1 * 1/2004 Grant, Jr. ..... F41G 11/003 42/112
2009/0064562 A1 * 3/2009 Casas Salva ..... F41G 11/003 42/124
2010/0043271 A1 * 2/2010 Williams ..... F41G 11/003 42/124
2010/0107467 A1 * 5/2010 Samson ..... F41G 11/003 42/127
2012/0174462 A1 * 7/2012 Spuhr ..... F41G 1/387 42/124
2015/0075054 A1 * 3/2015 Barger ..... F41G 11/003 42/90
2016/0102947 A1 * 4/2016 Visinski ..... F41C 27/00 42/90

FOREIGN PATENT DOCUMENTS

DE 202013007206 * 8/2013 ..... F41G 11/003
FR 2891616 A1 * 4/2007 ..... F41G 11/003

* cited by examiner

*Primary Examiner* — Gabriel Klein
(74) *Attorney, Agent, or Firm* — Lightfoot & Alford PLLC

(57) ABSTRACT

A riser for spacing a firearms accessory from a firearms accessory rail has a body, at least a portion of the body having approximately the same cross-sectional shape and slot configuration as a mounting portion of the accessory rail, at least one lug depending from the body and extending laterally, the lug being adapted for insertion into a slot of the accessory rail, and a hook adapted for coupling the riser to the accessory rail, the hook extending from a lateral end of the lug. At least a portion of the hook is adapted to be longitudinally aligned with the slot of the accessory rail and adapted to engage the accessory rail by contacting the accessory rail below the associated slot of the accessory rail.

17 Claims, 9 Drawing Sheets

RISER FOR FIREARMS ACCESSORY RAILS

CROSS-REFERENCE TO RELATED APPLICATION(S) AND CLAIM OF PRIORITY

The present application claims priority to U.S. Provisional Patent Application Ser. No. 62/105,203 filed Jan. 19, 2015 and entitled "Apparatus and Method for Mounting Objects to an Accessory Rail." The content of the '203 provisional application is incorporated herein by reference.

TECHNICAL FIELD

The present application relates generally to the field of firearms accessories and particularly to an apparatus and method for mounting objects to an accessory rail.

BACKGROUND

Firearm accessories are often installed on a firearm using an accessory rail, such as a "Weaver" or "Picatinny" rail, and a separate or integral mount is used to couple the accessory to the rail. FIG. 1 shows an example of a scope 11 mounted on rail 13 of firearm 15 with separate ring mounts 17, 19, whereas FIG. 2 shows a sight 21 mounted on rail 23 of firearm 25 with an integral mount 27.

FIG. 3 shows a portion of a typical accessory rail 29, which has slots 31 that extend laterally across rail 29 and define lugs 33. This full-lug configuration is also shown on rails 13, 23, though other styles of rails have only partial lugs on the lateral portions of the rail. Each slot 31 is defined by a depth from top lug surface 35 and a width between lugs 31, a bottom slot surface 37 extending across the full width of rail 29. Opposing pairs of angled clamping flats 39, 41 and 43, 45 are located on the lateral edges of rail 29, with continuous bottom flats 41, 45 and upper flats 39, 43 interrupted by slots 31.

FIG. 4 shows a typical two-piece mount configuration, with mount 47 comprising body 49 and clamp 51. Threaded nuts 53 are coupled to shafts 55, which extend across the width of body 49, and nuts 53 may be rotated relative to shafts 55 to apply compressive force against clamp 51. FIG. 5 shows mount 47 mounted on rail 29 (shown in phantom), with opposing pairs of flats 57, 59 and 61, 63 adjacent corresponding pairs of flats 39, 41 and 43, 45 on rail 29. Rotating nuts 53 pulls body 49 and clamp 51 together, clamping mount 47 on rail 29. Shafts 55 protrude below top lug surface 35 and into slots 31, allowing shafts 55 to limit the longitudinal motion of mount 47 on rail 29 by contacting a lug 33. Due to the opposing forces of rearward recoil of the firearm and inertia of the mount (and accessory), mount 47 is typically pushed forward during installation until one or more shafts 55 contacts a forward lug 33. In addition or alternatively, body 49 may have integral recoil lugs depending from body 49 and into slots 31.

FIG. 6 shows a one-piece mount configuration on a riser 65, which is used to space an accessory from an accessory rail. Riser 65 comprises a rail section 67 and a clamp section 69, with rail section 67 having a configuration of slots and lugs as described above for rail 29. Because riser 65 is one-piece, riser 65 is installed by removing fasteners 71 and sliding riser 65 longitudinally along an accessory rail to a desired position, and then fasteners 71 are reinstalled. Fasteners 71 extend through slots in the accessory rail, providing the same locating function as shafts 55 for mount 47 of FIGS. 4 and 5. Like mount 47, clamp section 69 has opposing pairs of flats for engaging the flats of the accessory rail, and fasteners 71 pull the lateral portions of clamp section 69 toward each other to provide a clamping force on the accessory rail.

Figure 1:
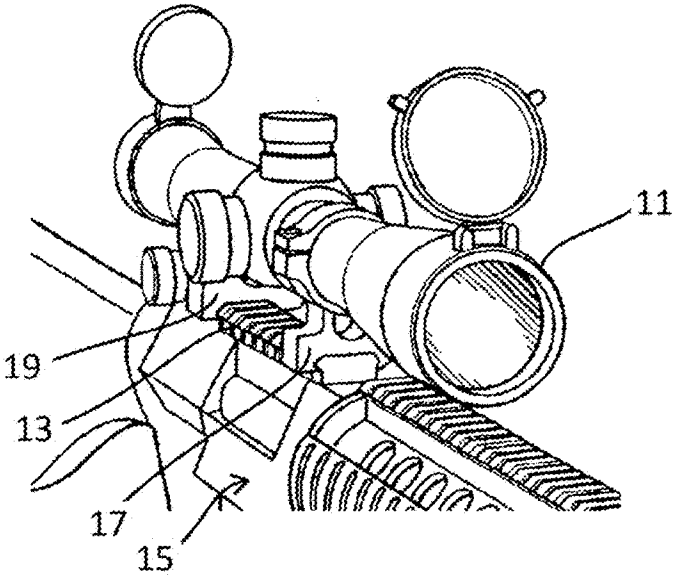
Fig. 1 (prior art)
FIG. 1 is a partial oblique view of an accessory mounted to an accessory rail of a firearm using a prior-art mount.
Figure 2:
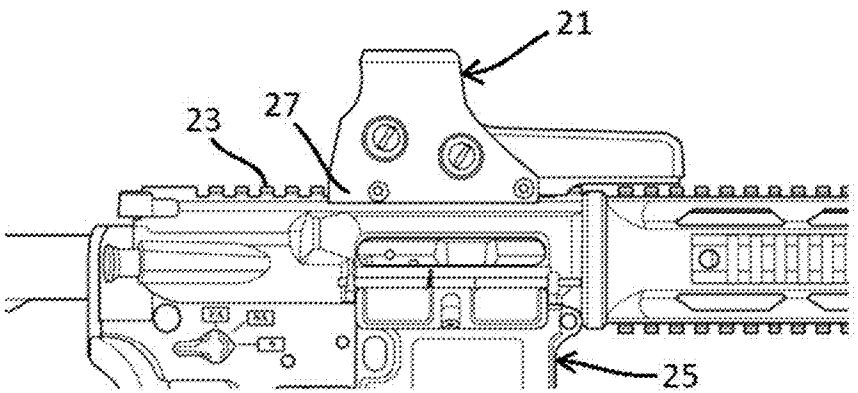
Fig. 2 (prior art)
FIG. 2 is a partial side view of a prior-art accessory mounted to an accessory rail of a firearm using an integral mount.
Figure 3:
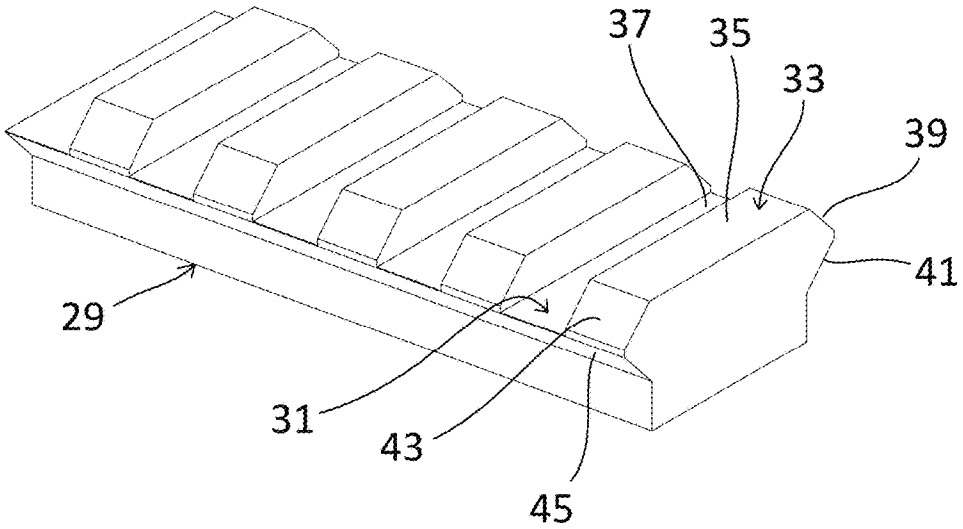
Fig. 3 (prior art)
FIG. 3 is an oblique view of a portion of a firearms accessory rail.
Figure 4:
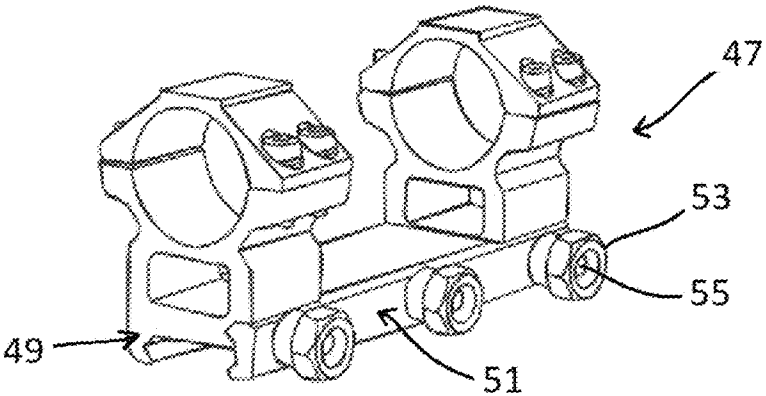
Fig. 4 (prior art)
FIG. 4 is an oblique view of a prior-art mount for a firearms accessory rail.
Figure 5:
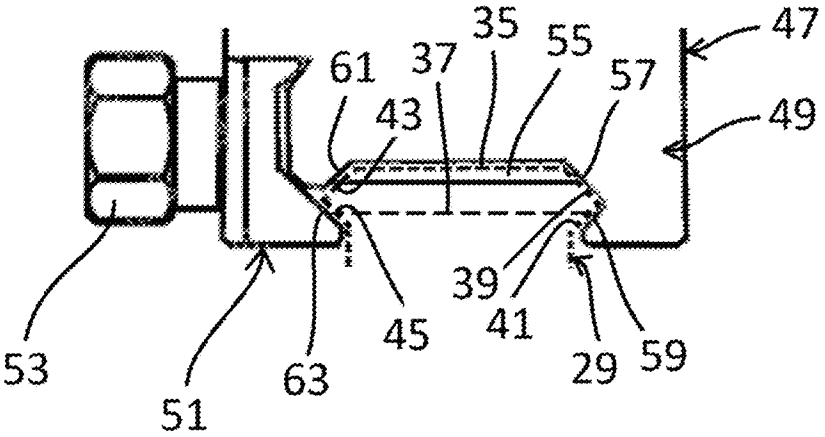
Fig. 5 (prior art)
FIG. 5 is an end view of the clamp section of the mount of FIG. 4.
Figure 6:
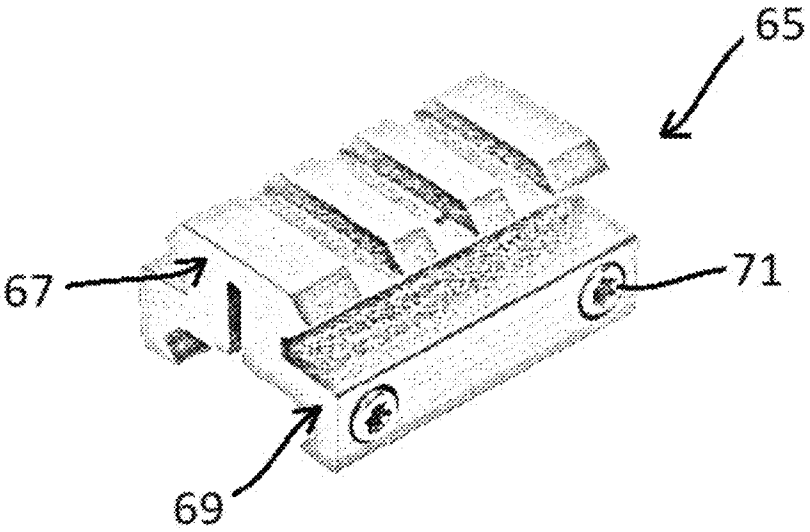
Fig. 6 (prior art)
FIG. 6 is an oblique view of a prior-art riser for spacing an accessory from an accessory rail.
Figure 7:
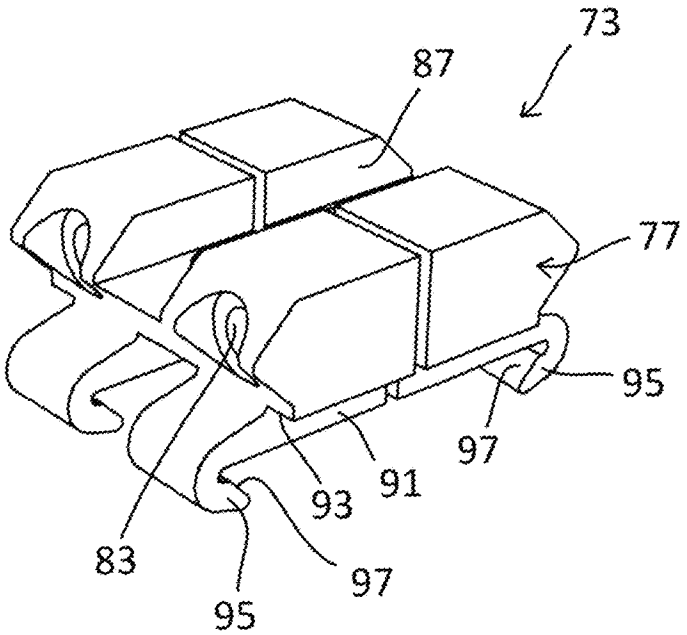
FIG. 7 is an oblique view of an embodiment of a riser according to this application.
Figure 8:
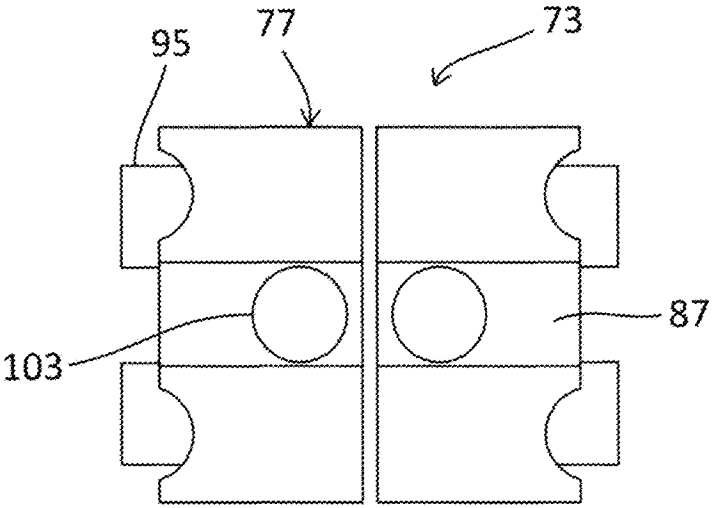
FIGS. 8, 9, and 10 are, respectively, top, end, and side views of the riser of FIG. 7.
Figure 9:
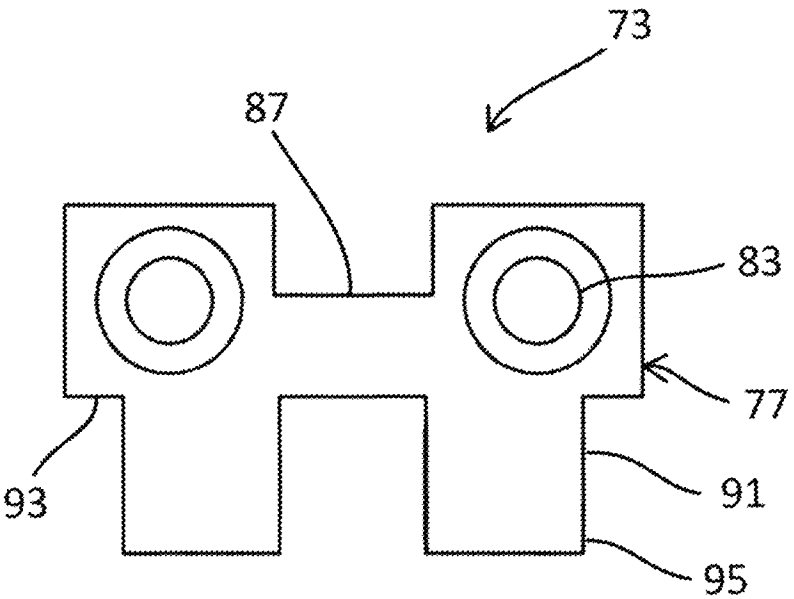
Figure 10:
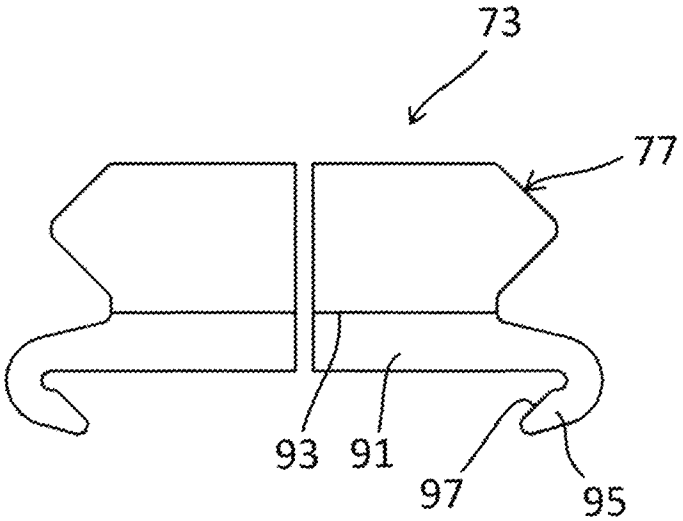
Figure 11:
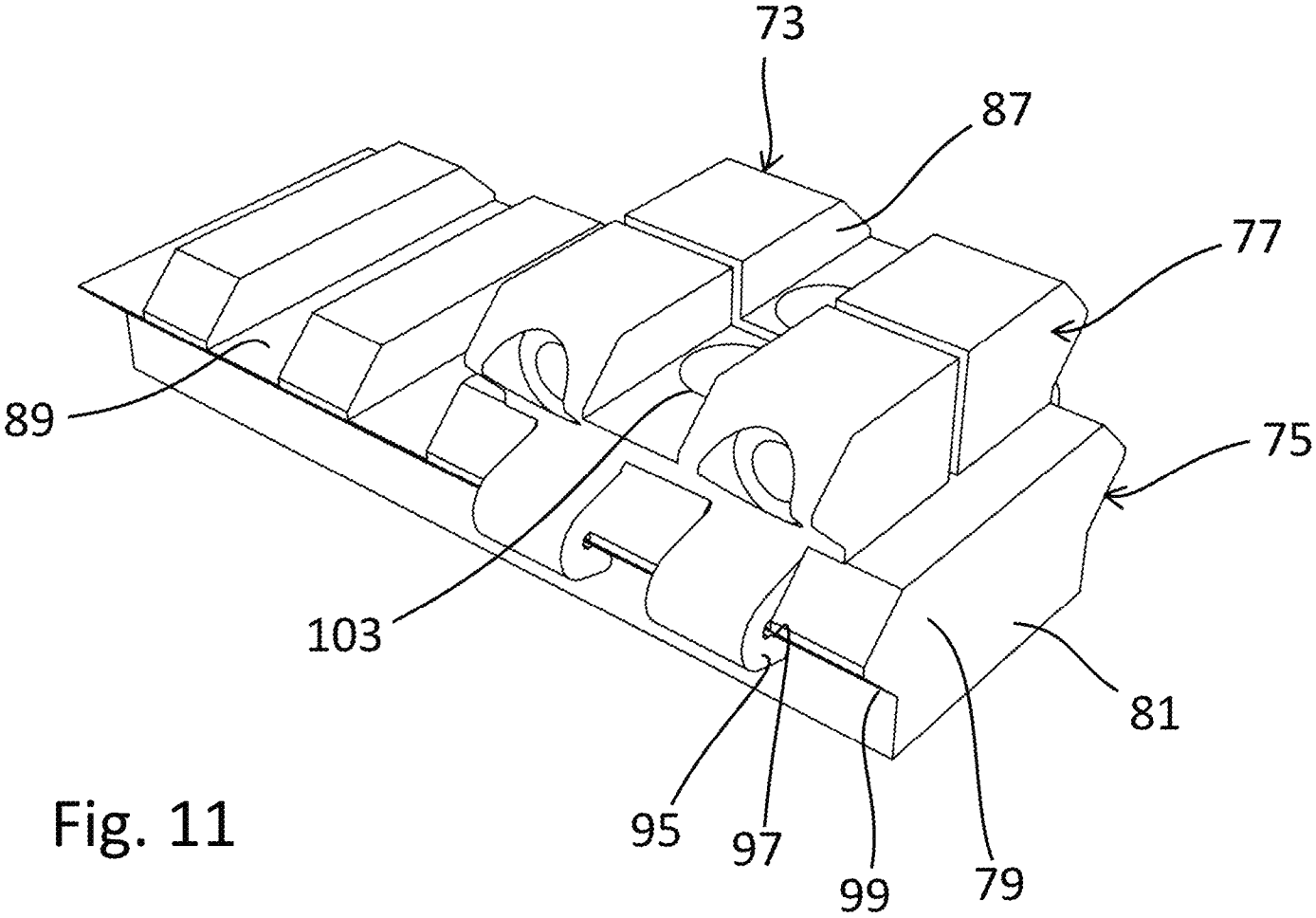
FIG. 11 is an oblique view of an assembly of the riser of FIG. 7 and an accessory rail.
Figure 12:
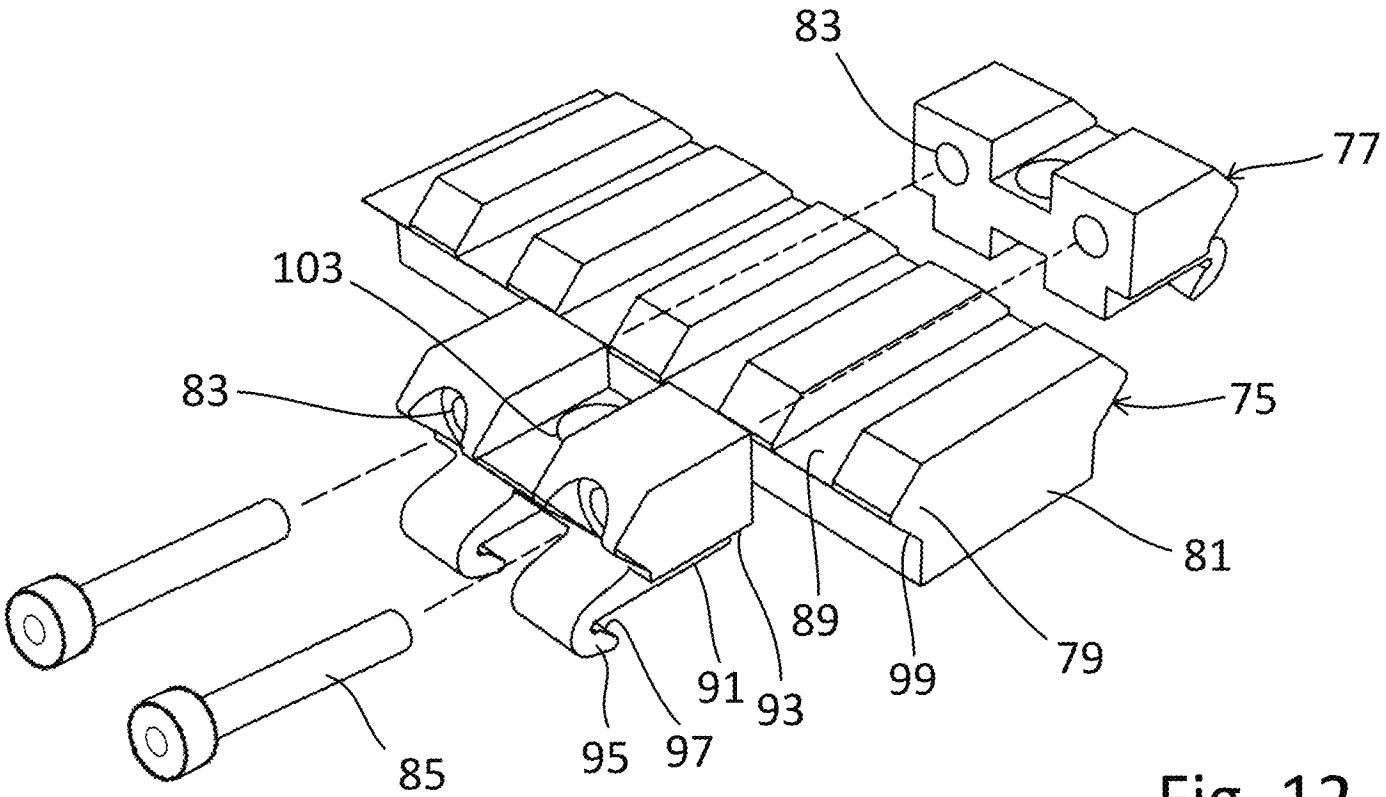
FIG. 12 is an exploded oblique view of the assembly of FIG. 11.
Figure 13:
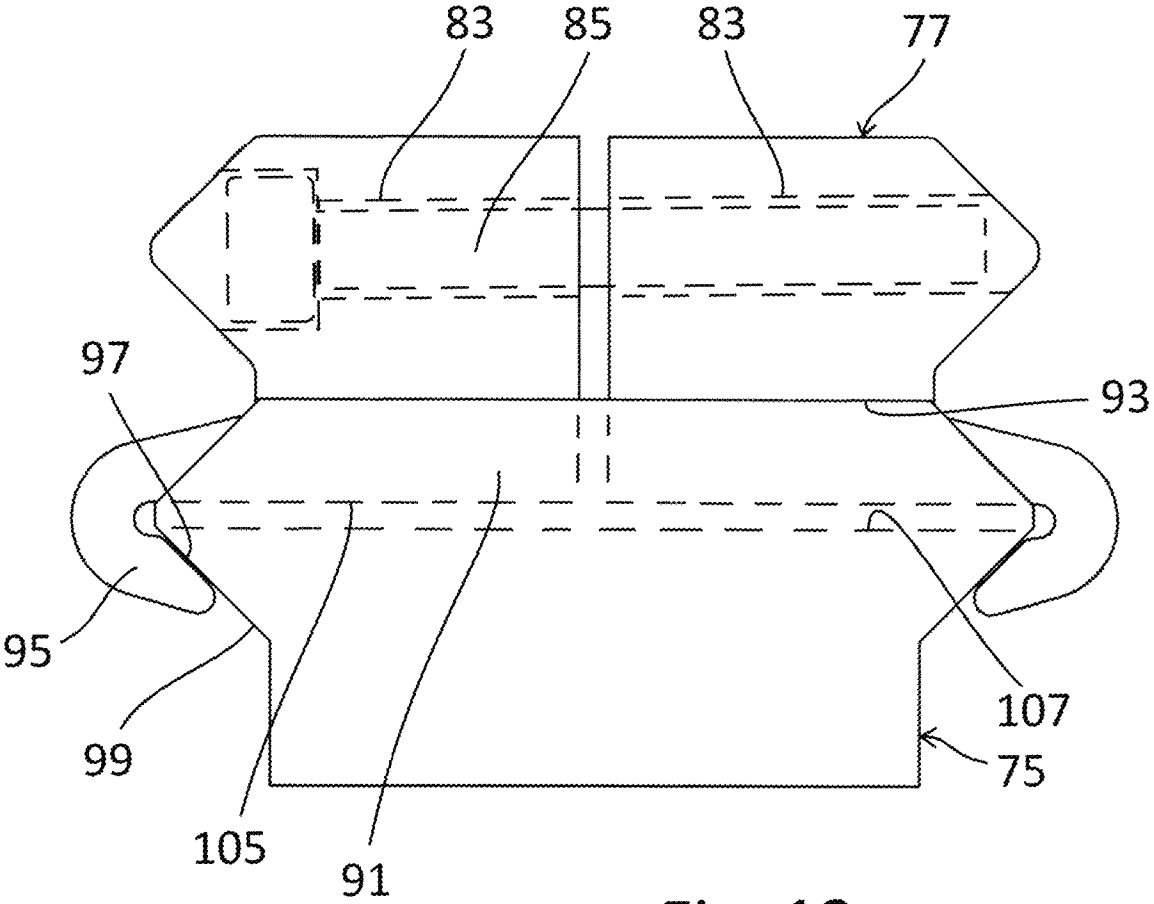
FIG. 13 is an end view of the assembly of FIG. 11, the components of the riser being laterally spaced from each other.

While the apparatus of this patent application is susceptible to various modifications and alternative forms, specific embodiments thereof have been shown by way of example in the drawings and are herein described in detail. It should be understood, however, that the description herein of specific embodiments is not intended to limit the application to the particular embodiments disclosed, but, on the contrary, the intention is to cover all modifications, equivalents, and alternatives falling within the spirit and scope of this application as defined by the appended claims.

DETAILED DESCRIPTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The embodiments herein and the various features and advantageous details thereof are explained more fully with reference to the non-limiting embodiments that are illustrated in the accompanying drawings and detailed in the following description. Descriptions of well-known components, processes, and manufacturing techniques are omitted so as to not unnecessarily obscure the embodiments herein. The examples used herein are intended merely to facilitate an understanding and to further enable those of skill in the art to practice the embodiments herein. Accordingly, the examples should not be construed as limiting the scope of the claimed invention.

In the specification, reference may be made to the spatial relationships between various components and to the spatial orientation of various aspects of components as the devices are depicted in the attached drawings. However, as will be recognized by those skilled in the art after a complete reading of this application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

FIGS. 7 through 15 show embodiments of a riser according to this application and used for spacing a firearms accessory from a firearms accessory rail. The main advantage of these designs is that they allow for a riser having a shorter height than has previously been achievable.

FIGS. 7 through 15 illustrate a riser 73, which is a quarter-inch riser adapted for use on an M1913 "Picatinny" rail 75 (shown in FIGS. 11 and 12), though riser 73 can be formed to have a taller height and be adapted for use on other styles of accessory rails. Riser 73 is preferably formed as two sections, and riser 73 is shown with identical sections having equal lateral width. However, riser 73 may be modified to have one section wider than the other, and riser 73 may alternatively be formed to have other equal or unequal size configurations for the sections of riser 73.

Each section of riser 73 has a section of body 77, the sections of body 77 cooperating to form a cross-sectional shape that is approximately the same as a mounting portion 79 of accessory rail 75, mounting portion 79 being formed or mounted atop a riser portion 81 of rail 75. Fastener holes 83 are formed in body 77 and extend laterally. In a typical configuration, fastener hole 83 in one section of body 77 is threaded, and hole 83 in the other section is not. This allows for a fastener 85 (shown in FIGS. 12 and 13) to retain sections of body 77 together. Depending on the length of riser 73, body 77 has at least one slot 87 that is the same configuration as slots 89 of accessory rail 75.

Lugs 91, which may be used as recoil lugs, depend from a lower surface 93 of body 77. Lugs 91 are sized for insertion into slots 89 of accessory rail 75. A hook 95 depends from each lateral end of lugs 91, each hook 95 having a clamping surface 97 for contacting a lower angled flat 99 of mounting portion 79 of rail 75. Hooks 95 may be rigid or may be designed to elastically deform under clamping pressure, so that hooks 95 can allow for dimensional variances in accessory rails 75, such as those from different manufacturers. Though shown with hooks on each lateral end of lugs 91, other embodiments may have a hook 95 on only one end of each lug 91 and an alternative clamping member on the other end of each lug 91.

Slots 89 of riser 73 and the cross-sectional shape of body 77 allow a user to install an accessory mount on riser 73 in the same manner that the user would install the accessory mount on rail 75, with riser 73 spacing the mount and any attached accessory a distance from rail 75 equal to the thickness of body 77. The configuration of riser 73, in which hooks extend from lug 91 located within slot 87 of rail 75 differs from the standard configuration of a mount encircling the cross-section of mounting portion 79 of rail 75, as can be seen in the mounts of FIGS. 1, 2, 4, and 6. This new and advantageous configuration positions the hooks 95 below body 77, and this allows for many, if not most, of the typical accessory mounts to be attached to body 77 when riser 73 is installed on rail 75. Thus, a quarter-inch increase in spacing of the mounted accessory from rail 75 can be achieved.

Figure 14:
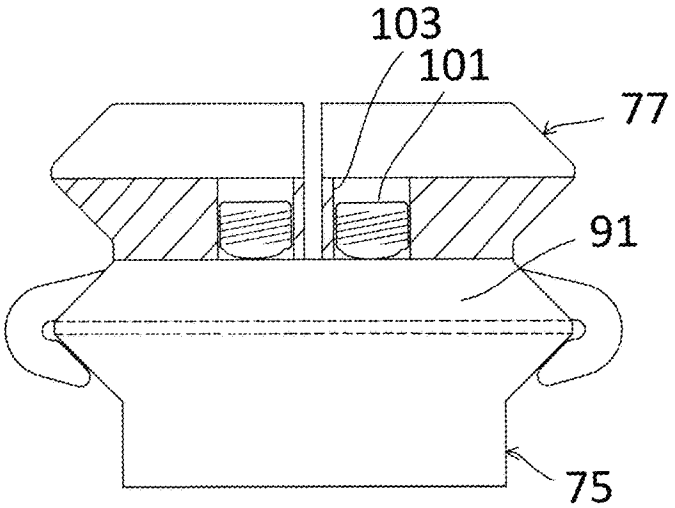
FIG. 14 is a cutaway end view of the assembly of FIG. 11.

FIG. 14 shows a cutaway end view of riser 73 mounted on rail 75. An optional method of adjusting for dimensional variances in rail 75 is the use of height adjusters, such as set screws 101 located in holes 103. When sections of body 77 are tightened toward each other but cannot be pulled adjacent, adjusters 101 can be used to adjust for a gap between lower surface 93 of each section of body 77 and the top surface of lugs of rail 75. This is accomplished by rotating each screw downward until it contacts the upward-facing surface of a corresponding lug. When necessary, adjusters 101 are adjusted to maintain sections of body 77 in a parallel orientation.

Figure 15:
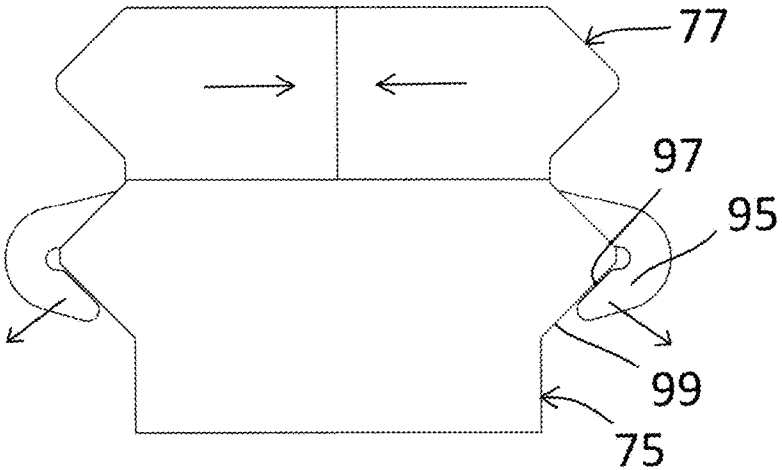
FIG. 15 is an end view of the assembly of FIG. 11, the components of the riser being laterally adjacent each other.

FIG. 15 shows riser 73 installed on rail 75 with sections of body 77 pulled together by fasteners 85 (not shown). This may be accomplished through dimensional accuracy of both riser 73 and rail 75 or through elastic deformation of hooks 95. As shown in the figure, sections of body 77 are moved toward each other as fasteners 85 are rotated, and this may cause hooks 95 to deform outwardly as surface 97 of each hook 95 is pressed against flat 99.

It should be noted that the hooks of risers according to this patent application may have alternative configurations from those shown and described above. For example, the hooks on each section of a riser may have different thickness, radius, or other characteristics, providing for differing values of stiffness. In one alternative embodiment, the hooks on one section of a riser are formed to be substantially rigid, whereas the hooks on the other section are formed to elastically deform, providing for deformation of the hooks on only one section of the riser.

An apparatus has been provided with several advantages, including: 1) the ability to provide an accessory riser sized for lifting an accessory a quarter-inch in height from an accessory rail; and 2) the ability to account for tolerances in the dimensions of the accessory rail.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although this patent application includes a limited number of forms of the apparatus, it is not limited to just these forms, but is amenable to various changes and modifications without departing from the spirit thereof.

The invention claimed is:

1. A riser for spacing a firearms accessory from a firearms accessory rail, comprising:

a body, at least a portion of the body having approximately the same cross-sectional shape and slot configuration as a mounting portion of the accessory rail, the body comprising two sections, the sections having holes extending laterally for accepting fasteners that retain the sections of the body together, the holes being located in the portion of the body having approximately the same cross-sectional shape as the mounting portion of the accessory rail;

at least one lug depending from the body and extending laterally, the lug being adapted for insertion into a slot of the accessory rail; and a hook adapted for coupling the riser to the accessory rail, the hook extending from a lateral end of the lug;

wherein at least a portion of the hook is adapted to be longitudinally aligned with the slot of the accessory rail and adapted to engage the accessory rail by contacting the accessory rail below the slot of the accessory rail.

2. The riser of claim 1, further comprising:

an adjuster adapted for maintaining a selected spacing of the body from a top surface of the accessory rail.

3. The riser of claim 1, wherein the hook is elastically deformable and adapted to account for variations in dimensions of the accessory rail.

4. The riser of claim 1, wherein the lug is located below a slot of the body.

5. The riser of claim 1, wherein the lug is longitudinally offset from a slot of the body.

6. The riser of claim 1, wherein a majority of the hook is located below the body.

7. The riser of claim 1, wherein the entire hook is located below the body.

8. A riser for spacing a firearms accessory from a firearms accessory rail, comprising:

a body comprising two sections, at least a portion of the body having approximately the same cross-sectional shape and slot configuration as a mounting portion of the accessory rail, the at least a portion of the body having a topmost surface;

at least one lug depending from the body and extending laterally, the lug being adapted for location within a slot of the accessory rail when the body is adjacent the accessory rail; and a hook adapted for coupling the riser to the accessory rail, the hook extending from a lateral end of the lug;

wherein at least a portion of the hook is adapted to be longitudinally aligned with the slot of the accessory rail and adapted to engage the accessory rail by contacting the accessory rail below the slot of the accessory rail; and wherein a distance between the topmost surface and a top surface of the accessory rail is approximately 0.25 inches when the riser is coupled to the accessory rail.

9. The riser of claim 8, further comprising:

an adjuster adapted for maintaining a selected spacing of the body from a top surface of the accessory rail.

10. The riser of claim 8, wherein the hook is elastically deformable and adapted to account for variations in dimensions of the accessory rail.

11. The riser of claim 8, the sections having holes formed in the body and extending laterally for accepting fasteners that retain the sections of the body together.

12. The riser of claim 11, wherein the holes are located in the portion of the body having approximately the same cross-sectional shape as the mounting portion of the accessory rail.

13. The riser of claim 8, wherein the lug is located below a slot of the body.

14. The riser of claim 8, wherein the lug is longitudinally offset from a slot of the body.

15. The riser of claim 8, wherein a majority of the hook is located below the body.

16. The riser of claim 8, wherein the entire hook is located below the body.

17. A riser for spacing a firearms accessory from a firearms accessory rail, comprising:

a body, at least a portion of the body having approximately the same cross-sectional shape and slot configuration as a mounting portion of the accessory rail, the at least a portion of the body having a topmost surface;

at least one lug depending from the body and extending laterally, the lug being adapted for location within a slot of the accessory rail when the body is adjacent the accessory rail; and a hook adapted for coupling the riser to the accessory rail, the hook extending from a lateral end of the lug;

wherein at least a portion of the hook is adapted to be longitudinally aligned with the slot of the accessory rail and adapted to engage the accessory rail by contacting the accessory rail below the slot of the accessory rail; wherein a distance between the topmost surface and a top surface of the accessory rail is approximately 0.25 inches when the riser is coupled to the accessory rail; and wherein a majority of the hook is located below the body.

* * * * *